United States Patent [19]

Spinner

[11] Patent Number: 5,059,139

[45] Date of Patent: Oct. 22, 1991

[54] COAXIAL CABLE FITTING

[76] Inventor: Georg Spinner, Am Eichberg 12, 8152 Feldkirchen-Westerham, Fed. Rep. of Germany

[21] Appl. No.: 424,889

[22] Filed: Oct. 20, 1989

[30] Foreign Application Priority Data

Oct. 21, 1988 [DE] Fed. Rep. of Germany ..... 3835995

[51] Int. Cl.[5] ..... H01R 17/18

[52] U.S. Cl. ..... 439/583; 439/578

[58] Field of Search ..... 439/578–585, 439/675, 322, 344

[56] References Cited

U.S. PATENT DOCUMENTS

| | | | |
|---|---|---|---|
| 2,870,420 | 1/1959 | Malek | 439/583 |
| 3,104,145 | 9/1963 | Somerset | 439/584 |
| 3,184,706 | 5/1965 | Atkins | 439/584 |
| 3,320,575 | 5/1967 | Brown et al. | 439/584 |
| 3,907,399 | 9/1975 | Spinner | 439/583 |
| 4,076,367 | 2/1978 | Avins | 439/583 |
| 4,093,335 | 6/1978 | Schwartz et al. | 439/583 |

FOREIGN PATENT DOCUMENTS

| | | | |
|---|---|---|---|
| 0194242 | 2/1965 | Sweden | 439/583 |
| 0810556 | 3/1959 | United Kingdom | 439/584 |

*Primary Examiner*—David L. Pirlot

*Attorney, Agent, or Firm*—Henry M. Feiereisen

[57] ABSTRACT

A coaxial cable fitting includes a metal bush receiving a cable end of a coaxial cable and adapted for making electric contact with the outer conductor of the coaxial cable, a contact clamp placed over the cable end of the coaxial cable and defining an annular end face about which a section of the outer conductor is bent outwardly and a screw element threadably engageable with the metal bush for urging the contact clamp against the metal bush to thereby press the outwardly bent section of the outer conductor against a radial shoulder of the metal bush wherein the contact clamp is securely received against rotation in the metal bush at least in its end position.

14 Claims, 2 Drawing Sheets

COAXIAL CABLE FITTING

BACKGROUND OF THE INVENTION

The present invention refers to a coaxial cable fitting, and in particular to a coaxial cable fitting of the type in which a metal bush receives a cable end of the coaxial cable and makes electric contact with the cable outer conductor having a section bent outwardly about an annular surface of a contact clamp which is placed over the cable end and forced by a screw element against the metal bush so as to press the outer conductor against a radial shoulder of the metal bush.

Coaxial cable fittings of this type are generally known and are suitable for providing a tension-proof and, if necessary, a sealed connection of a coaxial cable with a rigid connector such as a plug, a jack or a coupling. Generally, the coaxial cable fitting is of stuffing box-like design in which a screw element such as a hollow screw plug or a coupling ring and a radially elastic contact clamp cooperate with each other to attain the axially oriented contact pressure and a sufficient mechanically tight connection between the cable outer conductor or the cable sheath and the metal bush e.g. the plug. The connection of the inner conductor can be accomplished in various ways which are, however, independent of the type of the outer conductor connection and thus of no relevance with regard to the present invention.

In conventional coaxial cable fittings, the metal bush is provided at its part receiving the cable end with a hollow-cylindrical bore in which the contact clamp is centered and guided with its complementary cylindrical outer circumferential surface. Since the screw element and the contact clamp are frictionally engaged, the contact clamp often rotates during tightening of the screw element leading to a twisting of the cable because the contact clamp is also frictionally engaged with the outer conductor or the cable sheath. A twisting of the cable is, however, disadvantageous not only for mechanical reasons and electrical reasons but also because it leads to a torsional strain of the cable inner conductor since the latter is generally non-rotatably connected with the inner conductor contact element of the cable fitting which in turn is non-rotatably mounted. Evidently, this torsion may result in premature rupturing especially of coaxial cables with sensitive inner conductor.

SUMMARY OF THE INVENTION

It is thus an object of the present invention to provide an improved coaxial cable fitting obviating the aforestated drawbacks.

This object and others which will become apparent hereinafter are attained in accordance with the present invention by locking the contact clamp at least in its end position in the metal bush so as to prevent rotation of the contact clamp relative to the metal bush.

Preferably, the locking mechanism is accomplished by providing the outer circumference of the contact clamp with a profile which is at least partly complementary to the profile of the inner circumference of the metal bush.

Suitably, the cooperating surfaces of the inside wall of the metal bush and the outer circumference of the contact clamp have the shape of inscribed, preferably uniform polygons such as for example hexagonal shape so that after assembly of the coaxial cable fitting the contact clamp is securely mounted in the metal bush.

Thus, the contact clamp can be manufactured very inexpensively from a respectively profiled material. Alternatively, a complementary profiling may also be attained by providing the inside wall of the metal bush with an axial groove which is engageable by a pin radially projecting from the outer circumference of the contact clamp.

According to a further feature of the present invention, the contact clamp may be provided at least partly in radial elastic manner. Preferably, at its cable-distant side, the contact clamp includes tongues with conically tapered outer diameter which surround the cable sheath and cooperate with a corresponding conical inner surface of the screw element to attain a clamping action on the cable sheath.

In order to mount the contact clamp on the cable sheath at a fixed and defined position relative to the end of the outer conductor, the contact clamp is provided with a tapping inner thread. Thus, when being bent outwardly about the contact clamp, the outer conductor is prevented from radially projecting beyond the circumferential area of the contact clamp when suitably sizing the projecting end of the outer conductor beyond the cable sheath.

BRIEF DESCRIPTION OF THE DRAWING

The above and other objects, features and advantages of the present invention will now be described in more detail with reference to the accompanying drawing in which.

DETAILED DESCRIPTION OF PREFERRED EMBODIMENTS

Figure 1:
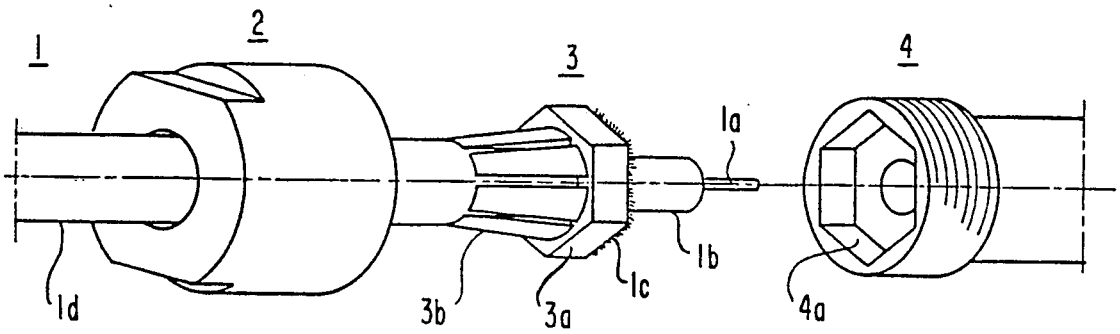
FIG. 1 is a perspective illustration of one embodiment of a coaxial cable fitting according to the present invention prior to assembly.

Referring now to the drawing, and in particular to FIG. 1, there is shown a perspective illustration of one embodiment of a coaxial cable fitting according to the present invention which is especially suitable for outer conductors in form of a braided wire. FIG. 1 illustrates a coaxial cable generally designated by reference numeral 1 and including an inner conductor 1*a* which is centered inside a cable insulation 1*b* so 1*d* as to be insulated from an outer conductor 1*c* which is shown in form of a braiding. Protecting the coaxial cable 1 against the outside is a cable sheath 1*d*. Placed over the cable sheath 1*d* is a screw element in form of a threaded sleeve generally designated by reference numeral 2 and a metallic contact clamp generally designated by reference numeral 3. As shown in FIG. 1, the cable end of the coaxial cable 1 is suitably prepared by having the inner conductor 1*a* extend beyond the cable insulation 1*b* so that the end of the inner conductor 1*b* is exposed and by outwardly bending the outer conductor braiding 1*c* about the cable end near end face of the contact clamp 3.

The contact clamp 3 has a hexagon head 3*a* and a plurality of radially elastic tongues 3*b* which are uniformly spaced about the hexagon head 3*a* at its side distant to the cable end and tapered toward the cable sheath 1*d* to enclose the latter.

Figure 3:
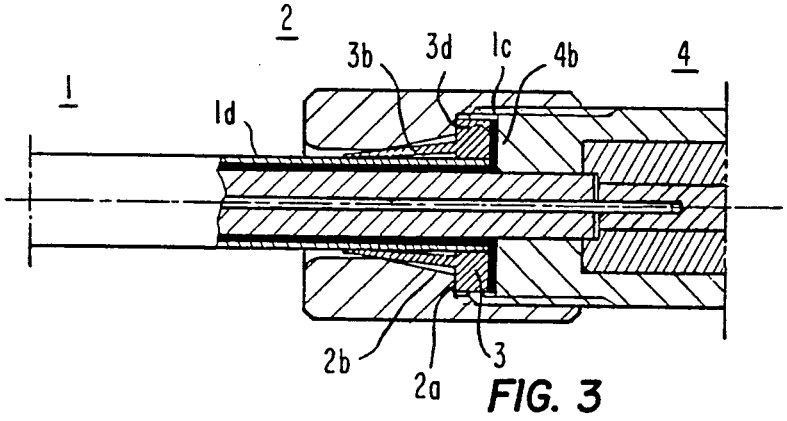
FIG. 3 is a longitudinal section of the assembled coaxial cable fitting of FIG. 1.

Cooperating with the contact clamp 3 is a metal bush 4 which is shown in FIG. 1 prior to assembly of the coaxial cable fitting and in FIG. 3 after assembly of the coaxial cable fitting. The metal bush 4 is provided with a hexagon socket 4*a* which is complementary to the hexagon profile of the head 3*a* and is provided with an external thread 5 cooperating with an internal thread of the sleeve 2. For ease of illustration, FIG. 1 shows only the essential elements of the metal bush 4 and does not illustrate the inner conductor connection and the continuing parts thereof.

Upon assembling the cable fitting, the threaded sleeve 2 is pushed over the contact clamp 3 and is threadably engaged with the metal bush 4 which is placed over the contact clamp 3. As shown in FIG. 3, the sleeve 2 is provided with an inner annular shoulder 2*a* which is pressed in axial direction against the head 3*a* of the contact clamp 3 so that the braiding 1*c* is sandwiched and clamped between the annular end face 3*d* of the head 3*a* and a radial shoulder 4*b* of the metal bush 4. As further shown in FIG. 3, the sleeve 2 is also provided with an inner conical surface 2*b* which during assembly slides over the tongues 3*b* of the contact clamp 3 to thereby radially push together the tongues 3*b* for attaining a clamping action on the cable sheath 1*d*.

Figure 5:
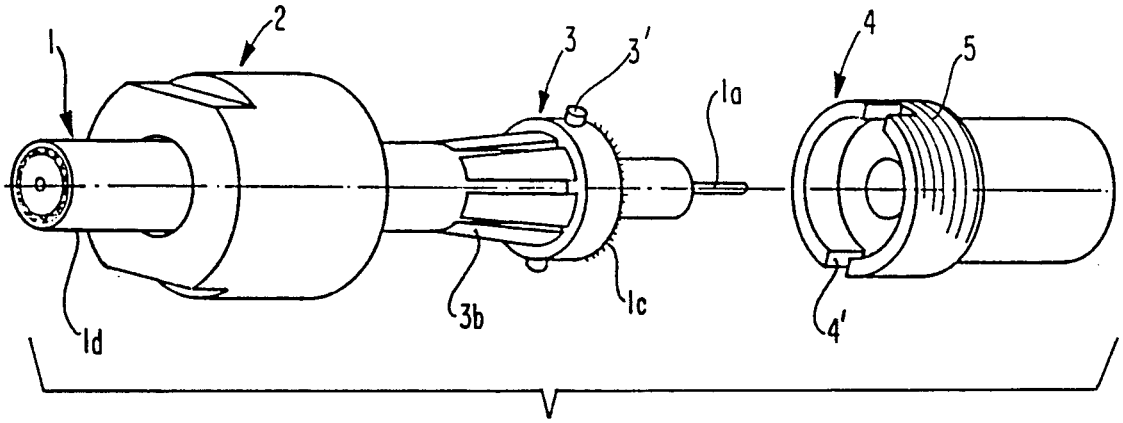
FIG. 5 is a perspective illustration of a modification of the embodiment of FIG. 1 in accordance with the present invention.
Figure 1:
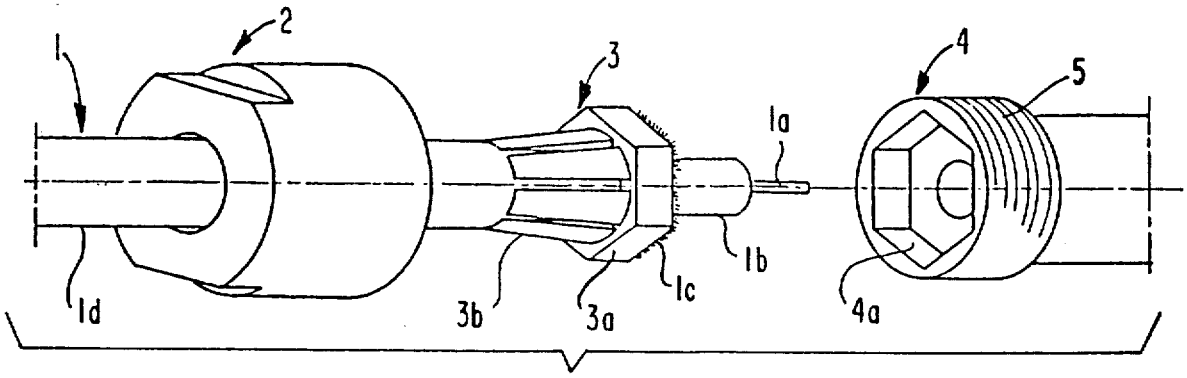
Figure 2:
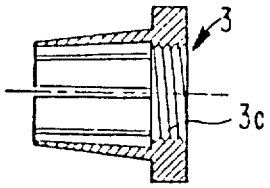
Figure 3:
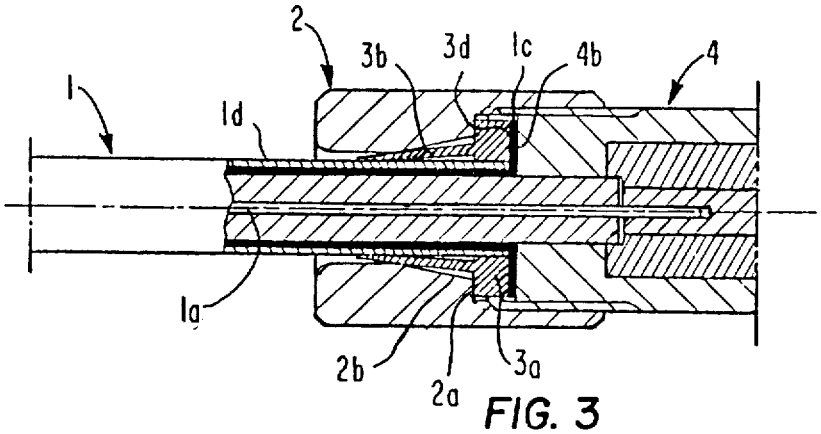
Figure 4:
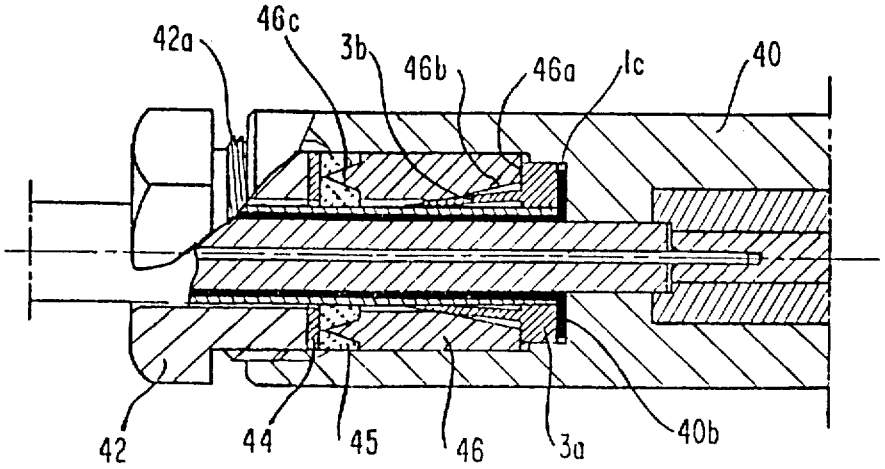

In the assembled state of the coaxial cable fitting, the complementary external hexagonal circumference of the head 3*a* and the internal hexagonal circumference of the metal bush 4 lock the contact clamp 3 when being received in its end position in the metal bush 4 so as to prevent the contact clamp 3 from rotating relative to the metal bush 4. It will be readily recognized that the profile of the complementary circumferential surfaces of the contact clamp 3 and the metal bush 4 does not have to be hexagonal; rather any other polygonal shape is to be considered within the scope of the present invention. Alternatively to the complementary profile of the circumferential surfaces of the contact clamp 3 and the metal bush 4 as illustrated in FIG. 1, a complementary profiling between the contact clamp 3 and the metal bush 4 to lock the contact clamp 3 against rotation when being received in the metal bush 4 may also be attained, as shown in FIG. 5, by providing the inside surface of the metal bush 4 with opposing axial grooves or slots 4' which are engageable by complementary pins 3' radially projecting from the outer circumference of the contact clamp 3. The illustration of FIG. 5 is made only by way of example, and it is certainly within the scope of the present invention to provide the metal bush with only one such groove or more than two grooves cooperating with a complementary number of pins of the contact clamp.

Figure 2:
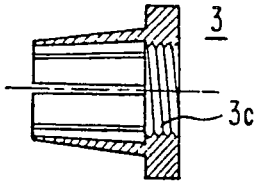
FIG. 2 is a longitudinal section of a tapping contact clamp.

FIG. 2 shows a longitudinal section of a contact clamp 3 which is provided with a tapping inner thread 3*c* so that the contact clamp 3 is tightly attached over the cable sheath 1*d*. Thus, after suitably preparing the cable end of the coaxial cable 1 prior to mounting the cable fitting, the contact clamp 3 has a fixed and defined position relative to the end of the outer conductor 1*c* which after suitably sizing the projecting end of the outer conductor 1*c* beyond the cable sheath 1*d* and after being bent radially outwards is prevented from extending beyond the periphery of the contact clamp 3.

Figure 4:
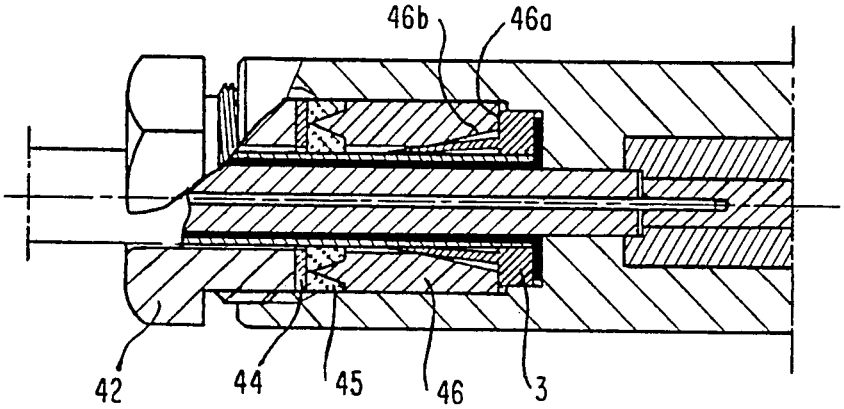
FIG. 4 is a longitudinal section of another embodiment of an assembled coaxial cable fitting according to the present invention.

Turning now to FIG. 4, there is shown a longitudinal section of another embodiment of an assembled coaxial cable fitting according to the present invention and provided for attaining a sealed connection. The coaxial cable fitting includes a hollow screw plug 42 with an external thread 42*a* which is in mesh with an internal thread of a metal bush 40. For providing sufficient pressure to clamp the braiding 1*c* between the head 3*a* and the facing radial shoulder 40*b* of the metal bush 40 and for pushing the tongues 3*b* together in radial direction to attain the clamping action, an intermediate ring 46 is arranged between the head 3*a* and the screw plug 42 and urged by the screw plug 42 with its annular shoulder 46*a* against the head 3*a* via a disk 44 and a profiled ring 45 of elastic material.

The intermediate ring 46 is provided with a conical inner surface 46*b* to force the tongues 3*b* in radial direction toward the cable sheath 1*d* to create the clamping action. At its end facing the screw plug 42, the intermediate ring 46 includes a truncated cone-shaped elongation 46*c* which projects into a complementary recess in the profiled ring 45 so that the screw plug 42 suitably presses the intermediate ring 46 against the contact clamp 3.

It will be appreciated that the coaxial cable 1 is illustrated only by way of example and may include an outer conductor of different design and make as long as the contacting end thereof is bendable outwardly about the contact clamp 3. For instance, it is possible to employ the coaxial cable fitting according to the invention for connecting an outer conductor which may be made of a wound metal foil or may even be a metal pipe, with the contacting end being suitably flanged or bent outwardly.

While the invention has been illustrated and described as embodied in a coaxial cable fitting, it is not intended to be limited to the details shown since various modifications and structural changes may be made without departing in any way from the spirit of the present invention.

What is claimed as new and desired to be protected by Letters Patent is set forth in the appended claims.

I claim:

1. A coaxial cable fitting, comprising:

a metal bush receiving a cable end of a coaxial cable and adapted for making electric contact with the outer conductor of the coaxial cable;

a contact clamp placed over the cable end of the coaxial cable and defining a cable end near annular end face about which a section of the outer conductor is bent outwardly;

a screw element threadably engageable with said metal bush for urging said contact clamp against said metal bush to thereby press the outwardly bent section of the outer conductor against a radial shoulder of said metal bush; and locking means for preventing rotation of said contact clamp relative to said metal bush when being received in its end position in said metal bush, said locking means being defined by radially facing, at least partly complementary profiled surfaces of said contact clamp and said metal bush.

2. A fitting as defined in claim 1, with the coaxial cable being covered by a cable sheath, wherein at its end facing away from the cable end said contact clamp includes tongues enclosing the cable sheath and having a conically tapered outer diameter, said screw element including an inner conical surface cooperating with said tongues of said contact clamp to attain a sufficient clamping action on the cable sheath.

3. A fitting as defined in claim 1 with the coaxial cable being covered by a cable sheath, said contact clamp being provided with a tapping internal thread to tightly attach said contact clamp on the cable sheath.

4. A fitting as defined in claim 1 wherein said contact clamp has an outer circumferential surface and said metal bush has an inner circumferential surface, said locking means including an at least partly complementary profile of said outer circumference of said contact clamp and of said inner circumferential surface of said metal bush to lock said contact clamp against rotation.

5. A fitting as defined in claim 4 wherein said complementary profile of said contact clamp and said metal bush has the shape of inscribed polygons.

6. A fitting as defined in claim 4 wherein said complementary profile of said contact clamp and said metal bush has the shape of inscribed uniform polygons.

7. A fitting as defined in claim 1 wherein said screw element is a hollow screw plug with external thread cooperating with an internal thread of said metal bush for attaining a pressure-sealed connection.

8. A fitting as defined in claim 7, with the coaxial cable being covered by a cable sheath, wherein at its end facing away from the cable and said contact clamp includes tongues enclosing the cable sheath and having a conically tapered outer diameter, and further comprising means for transmitting the pressure force exerted by said screw plug onto said contact clamp for clamping the outwardly bent section of the outer conductor against said metal bush and forcing said tongues of said contact clamp in radial direction to attain a clamping action, said transmitting means including a profiled ring acted upon by said screw plug and an intermediate ring in axial elongation of said profiled ring and provided with an inner conical surface cooperating with said tongues of said contact clamp.

9. A fitting as defined in claim 8 wherein said profiled ring is made of elastic material.

10. A fitting as defined in claim 8 wherein said transmitting means further includes a disk sandwiched between said screw plug and said profiled ring.

11. A fitting as defined in claim 8 wherein said intermediate ring is provided with a projecting end engaging a complementary recess of said profiled ring.

12. A fitting as defined in claim 11 wherein said projected end of said intermediate ring is truncated cone shaped.

13. A fitting for a coaxial cable of the type having an outer conductor braiding, comprising:

a metal bush receiving a cable end of the coaxial cable and adapted for making electric contact with the outer conductor;

a contact clamp placed over the cable end of the coaxial cable and defining a cable end near annular end face about which a section of the outer conductor braiding is bent outwardly;

a screw element threadably engageable with said metal bush for urging said contact clamp against said metal bush to thereby press the outwardly bent section of the outer conductor braiding against a radial shoulder of said metal bush; and locking means for preventing rotation of said contact clamp relative to said metal bush when being received in its end position in said metal bush, said locking means being defined by radially facing and at least partly complementary profiled surfaces of said contact clamp and said metal bush.

14. A coaxial cable fitting, comprising:

a metal bush receiving a cable end of a coaxial cable and adapted for making electric contact with the outer conductor of the coaxial cable;

a contact clamp placed over the cable end of the coaxial cable and defining a cable end rear annular end face about which a section of the outer conductor is bent outwardly;

a screw element threadably engageable with said metal bush for urging said contact clamp against said metal bush to thereby press the outwardly bent section of the outer conductor against a radial shoulder of said metal bush; and locking means for preventing rotation of said contact clamp relative to said metal bush when being received in its end position in said metal bush, said locking means being defined by at least one groove-pin arrangement, with said metal bush having an inner wall provided with an axial groove, and with said contact clamp being provided with a radially extending pin which is engageable in said axial groove.

* * * * *

UNITED STATES PATENT AND TRADEMARK OFFICE

CERTIFICATE OF CORRECTION

PATENT NO. : 5,059,139

DATED : Oct. 22, 1991

INVENTOR(S) : Georg Spinner

It is certified that error appears in the above-identified patent and that said Letters Patent is hereby corrected as shown below:

The title page should be deleted to appear as per attached title page.

The printed sheet of drawing consisting of Figs. 1,2,3 and 4 should be deleted.
The sheet of drawing consisting of Figs. 1, 2, 3, and 4 should be added as shown on the attached sheet.

Signed and Sealed this

Twenty-third Day of March, 1993

*Attest:*

STEPHEN G. KUNIN

*Attesting Officer*

*Acting Commissioner of Patents and Trademarks*

United States Patent [19]

Spinner

[11] Patent Number: 5,059,139

[45] Date of Patent: Oct. 22, 1991

[54] COAXIAL CABLE FITTING

[76] Inventor: Georg Spinner, Am Eichberg 12, 8152 Feldkirchen-Westerham, Fed. Rep. of Germany

[21] Appl. No.: 424,889

[22] Filed: Oct. 20, 1989

[30] Foreign Application Priority Data

Oct. 21, 1988 [DE] Fed. Rep. of Germany ..... 3835995

[51] Int. Cl.[5] ..... H01R 17/18

[52] U.S. Cl. ..... 439/583; 439/578

[58] Field of Search ..... 439/578-585, 439/675, 322, 344

[56] References Cited

U.S. PATENT DOCUMENTS

| | | | |
|---|---|---|---|
| 2,870,420 | 1/1959 | Malek | 439/583 |
| 3,104,145 | 9/1963 | Somerset | 439/584 |
| 3,184,706 | 5/1965 | Atkins | 439/584 |
| 3,320,575 | 5/1967 | Brown et al. | 439/584 |
| 3,907,399 | 9/1975 | Spinner | 439/583 |
| 4,076,367 | 2/1978 | Avins | 439/583 |
| 4,093,335 | 6/1978 | Schwartz et al. | 439/583 |

FOREIGN PATENT DOCUMENTS

| | | | |
|---|---|---|---|
| 0194242 | 2/1965 | Sweden | 439/583 |
| 0810556 | 3/1959 | United Kingdom | 439/584 |

*Primary Examiner*—David L. Pirlot

*Attorney, Agent, or Firm*—Henry M. Feiereisen

[57] ABSTRACT

A coaxial cable fitting includes a metal bush receiving a cable end of a coaxial cable and adapted for making electric contact with the outer conductor of the coaxial cable, a contact clamp placed over the cable end of the coaxial cable and defining an annular end face about which a section of the outer conductor is bent outwardly and a screw element threadably engageable with the metal bush for urging the contact clamp against the metal bush to thereby press the outwardly bent section of the outer conductor against a radial shoulder of the metal bush wherein the contact clamp is securely received against rotation in the metal bush at least in its end position.

14 Claims, 2 Drawing Sheets

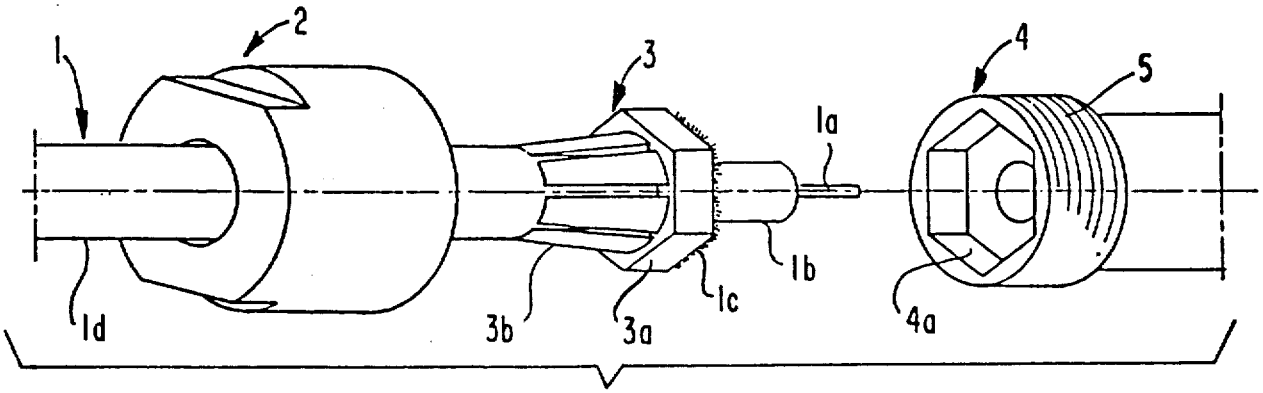

FIG. 1